United States Patent [19]

Langer et al.

[11] 4,007,581

[45] Feb. 15, 1977

[54] METHOD FOR THE SPINNING AND TWISTING OF YARN ON RING SPINNING FRAMES AND TWISTING FRAMES

[75] Inventors: Rolf Langer; Peter Thierfelder; Harald Geisler, all of Karl-Marx-Stadt, Germany

[73] Assignee: VEB Spinnereimaschinenbau, Karl-Marx-Stadt, Germany

[22] Filed: Sept. 18, 1975

[21] Appl. No.: 614,385

[30] Foreign Application Priority Data

Oct. 25, 1974 Germany ..... 0118190

[52] U.S. Cl. ..... 57/156; 57/73; 57/124

[51] Int. Cl.[2] ..... D01H 7/58

[58] Field of Search ..... 57/73, 75, 103, 105, 57/118, 122, 124, 34 R, 156

[56] References Cited

UNITED STATES PATENTS

| | | | |
|---|---|---|---|
| 2,541,238 | 2/1951 | Goree | 57/124 |
| 2,622,388 | 12/1952 | Roeder | 57/73 |
| 3,107,479 | 10/1963 | Kooistra | 57/73 |
| 3,118,270 | 1/1964 | Pinchon | 57/124 X |
| 3,738,094 | 6/1973 | Costales et al. | 57/75 |

FOREIGN PATENTS OR APPLICATIONS

| | | | |
|---|---|---|---|
| 146,543 | 4/1903 | Germany | 57/73 |
| 444,061 | 3/1936 | United Kingdom | 57/73 |

*Primary Examiner*—Donald E. Watkins
*Attorney, Agent, or Firm*—Nolte and Nolte

[57] ABSTRACT

In the spinning or twisting of continuous fibrous material at a spinning or twisting frame station comprising a spindle for carrying a bobbin, a ring concentrically mounted about the spindle and supporting a traveler for guiding the fibrous material onto the bobbin and means for driving the ring and the spindle, the improvement comprising engaging the fibrous material at the head of the spindle thereby to reduce or eliminate ballooning of the fibrous material and rotating the ring at a lesser rate that the spindle thereby to decrease the tension on the yarn.

3 Claims, 1 Drawing Figure

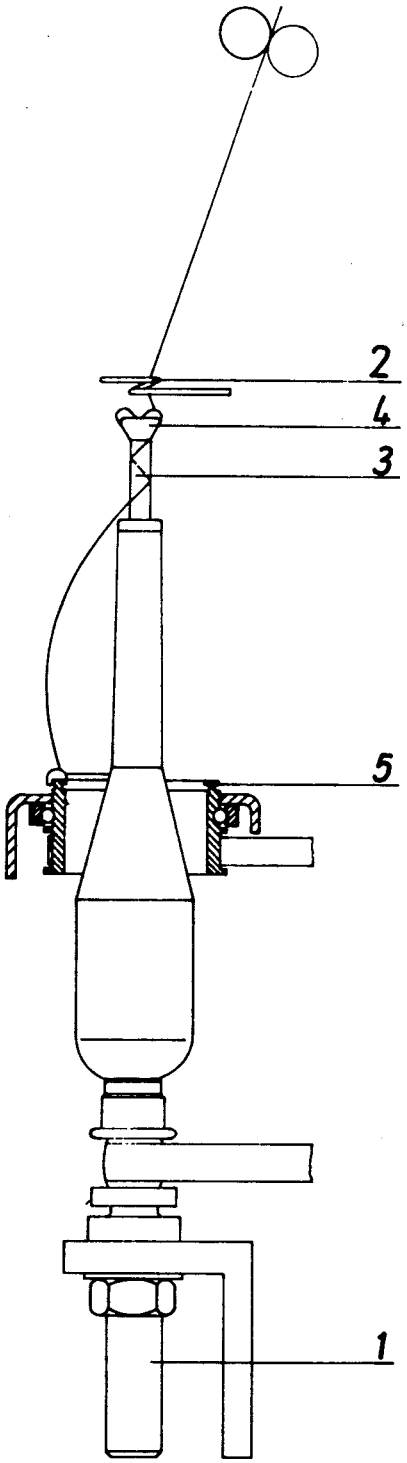
2
4
3
5
1

METHOD FOR THE SPINNING AND TWISTING OF YARN ON RING SPINNING FRAMES AND TWISTING FRAMES

The present invention relates to a method for increasing the production of ring spinning frames and ring twisting frames.

Many efforts have been made to increase as much as possible the yield of ring spinning frames and of ring twisting frames. Here the problem is to reduce all factors to a minimum which are obstacles to this aim, viz., the friction between spinning ring and spinning ring driver and also the forces which are exerted upon the yarn balloon. It is well known to reduce the tension of the yarn between the outlet of the drafting system and the ring driver by the addition of spindle head pieces, so-called spinning crowns, which leads to certain partial success. Recently, relatively satisfactory results have been obtained from spinning rings which followed the motion of the ring driver, thereby reducing friction between the ring and the driver. The spinning ring is either driven directly or it is carried along by its friction with the ring driver. The use of such spinning rings in contrast to the traditional spinning rings has resulted in a substantial increase in yield, as far as the delivery speed is concerned. It was noticed, though, that the use of those spinning rings has the disadvantage of a lack of synchronization between the spinning ring and the ring driver. The tension of the yarn is reduced only when spinning ring and ring driver run in unison. In this respect, another spinning method was developed. This method aims to perform the spinning action in two phases with a spindle driven by a motor, and by a spinning ring supported by air or magnetic bearing, the spinning ring being carried along by the ring driver. In the first phase, beginning at a dead halt, synchronization is attained between the spinning ring and the ring driver at a lower rate of revolution; in the second phase, the rate of revolution is increased up to the planned operating speed and regulated always in the synchronized mode until the end of the operation. Various measuring and controlling devices are provided for use in connection with the aforementioned method.

It is an object of the present invention to make it possible to further increase the speed of delivery without undue increase in cost.

Other objects and advantages of the invention will be apparent to those skilled in the art from the following description of the invention.

According to the invention, the synchronization between the spinning ring and the ring driver is eliminated without causing an undue increase in the tension of the yarn. This is accomplished by using a spindle head piece disposed upon the spindle, the head piece reducing the yarn balloon during the entire spinning process, or eliminating the balloon altogether, while simultaneously maintaining a synchronization between the spinning ring and the spindle by conventional driving means. Usually, the optimum difference between the rotational speeds of the spinning ring and the spindle is 40%.

This process increases the yield by 40 to 80% depending upon the denier or count of the yarns or threads.

The invention is further described hereinbelow by reference to a specific, preferred embodiment, as illustrated in the drawing, which is an elevation, partly in section, of a station in a ring spinning frame incorporating the invention.

A thread guide 2 is disposed concentrically above a spindle 1, between the spindle 1 and the exit of the drafting system. The spindle 1 is provided with a spindle head piece 3, the head piece being optionally exchangeable. Preferably, the spindle head piece 3 has a two-sided entrainment means 4. The way spindle 1 and spinning ring 5, which supports a guide for guiding the thread onto a bobbin on the spindle, are driven is a matter of preference. One has only to assure that one can, in keeping with the present invention, regulate the difference of the rotational speeds of the spinning ring 5 and the spindle 1. The spindle head piece 3 influences the yarn balloon in connection with the stress imposed by the driver in such a way that it is possible to work with a reduced yarn balloon or without a balloon altogether. Prolonged experiments in practical manufacturing situations have shown that the tension of the yarn, while using driven spinning rings, is reduced only when the spinning rings and the ring driver are synchronized. Synchronization is here defined as a rate of revolution (r.p.m.) of the ring in a range between 98.8 and 99.2% of the rate of revolution of the spindle. It is very difficult to keep within such a range in actual practice, as the condition is unstable. The forces within the balloon vary between high tension and a yarn tension value of 0, in other words, collapse of the balloon. Furthermore, spinning can be continued after a break in the yarn only when synchronization exists.

According to the present invention, the yarn balloon is kept at a reduced size during the entire spinning process; it may even be eliminated. This is done by mounting a spindle headpiece 3 or spinning crown upon the spindle 1. It is preferable to dispose between the exit of the drafting system and the spindle head piece 3 a yarn guide 2 centered above the spindle head piece 3. In addition to the use of the spindle head piece 3, the rotational speed of the spindle 1 is reduced. The reduction of the rotational speed of the spinning ring 4 in relation to spindle 1 may be up to 40%. If the rotational speed of the spindle is 18,000 r.p.m., the rotational speed of the spinning ring will be 10,800 r.p.m. The practice of the method of the invention, that is, working with a reduced yarn balloon or elimination thereof combined with rotating of the spinning ring 5 slower than the spindle 1, optimally 40% slower, results in a 50% to 80% increase of rate of delivery. Additionally, energy is saved in the driving of the spinning ring, mechanical wear is reduced, yarn breaks are greatly reduced, and it is always possible to continue spinning after breaks. Extensive measurements of yarn tensions have shown how advantageous is the method of the present invention even at extremely high r.p.m.'s of the spindle. When processing 100% cotton, medium staple, Nm 40, carded with 820 turns of twist per meter and the ring diameter is 50 mm., the following was found:

a) at normal spinning:

| r.p.m. of spindle | tension of yarn in grams |
|---|---|
| 10 000 | 20 |
| 11 000 | 23 |
| 12 000 | 30 |
| 13 000 | 45 |

b) with driven ring - without spindle head piece

| r.p.m. of spindle | r.p.m. of ring in % of r.p.m. of spindle | 0 | 50 | 60 | 70 | 80 | 90 | 98.8 |
|---|---|---|---|---|---|---|---|---|

-continued

| | | | | | | | |
|---|---|---|---|---|---|---|---|
| 10 000 | tension of yarn in grams | 20 | 25 | 25–30 | 25 | 32 | 38 | 8 |

c) with driven ring and spindle head piece

| r.p.m. of spindle | r.p.m. of ring as % of r.p.m. of spindle | tension: spinning onto 1st third of bobbin, cone base | spinning onto 1st third of bobbin, cone apex | spinning onto apex of bobbin, cone base | spinning onto apex of bobbin, cone apex |
|---|---|---|---|---|---|
| 14,200 | 60 | 3 | 2 | 3.5 | 4 |
| | 80 | 3 | 2 | 3.5 | 4.5 |
| 16,000 | 60 | 4 | 3 | 4 | 3 |
| | 80 | 4 | 3 | 3.5 | 5 |
| 18,000 | 60 | 5 | 3.5 | 4.5 | 5 |
| | 80 | 5 | 3.5 | 5 | 6 |
| 20,000 | 60 | 5.5 | 4 | 6 | 7.5 |

The tension of the yarn is extremely low while the yarn balloon is kept at a reduced size or altogether eliminated, when the spinning ring 5 is driven asynchronously in relation to the spindle 1 and when the spindle head piece 3 is disposed upon the spindle 1, thereby ensuring exact and undisturbed delivery of the yarn.

What is claimed is:

1. In the spinning or twisting of continuous fibrous material at a spinning or twisting frame station comprising a spindle for carrying a bobbin, a ring concentrically mounted about the spindle and supporting a traveler for guiding the fibrous material onto the bobbin, and means for driving the ring and spindle, the improvement comprising engaging the fibrous material at the head of the spindle thereby to reduce or eliminate ballooning of the fibrous material and rotating the ring and the spindle asynchronously with the ring being driven at a lesser rate than the spindle thereby to decrease the tension on the yarn.

2. In the method according to claim 1, in the improvement in which the ring is rotated at a rate as much as 40% less than the rate of rotation of the spindle.

3. In the method according to claim 1, in the improvement in which the ring is rotated at a rate 40% less than the rate of rotation of the spindle.

* * * * *